US006681587B2

(12) United States Patent
Murase

(10) Patent No.: US 6,681,587 B2
(45) Date of Patent: Jan. 27, 2004

(54) FLOW RESTRICTING STRUCTURE IN DISPLACEMENT CONTROLLING MECHANISM OF VARIABLE DISPLACEMENT COMPRESSOR

(75) Inventor: Masakazu Murase, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/193,893

(22) Filed: Jul. 12, 2002

(65) Prior Publication Data

US 2003/0010048 A1 Jan. 16, 2003

(30) Foreign Application Priority Data

Jul. 13, 2001 (JP) ..... 2001-213169

(51) Int. Cl.[7] ..... F25B 1/00; F04B 1/26

(52) U.S. Cl. ..... 62/228.5; 417/222.2

(58) Field of Search ..... 62/228.5, 228.3; 417/222.2, 222.1, 269, 270, 213; 74/60

(56) References Cited

U.S. PATENT DOCUMENTS 5,318,410 A 6/1994 Kawamura et al.
5,842,835 A * 12/1998 Kawaguchi et al. ..... 417/222.2
5,865,604 A 2/1999 Kawaguchi et al. ..... 417/222.2
5,890,878 A * 4/1999 Murase et al. ..... 417/222.2
5,964,578 A * 10/1999 Suitou et al. ..... 417/222.2
5,975,859 A * 11/1999 Kawaguchi et al. ..... 417/222.2
6,010,312 A * 1/2000 Suitou et al. ..... 417/222.2
6,062,823 A * 5/2000 Kawaguchi et al. ..... 417/222.2

FOREIGN PATENT DOCUMENTS

EP 0855 506 A2 7/1998 ..... F04B/27/18
JP 6-185460 7/1994 ..... F04B/27/08
JP 8-338364 12/1996 ..... F04B/27/14

* cited by examiner

*Primary Examiner*—Marc Norman
(74) *Attorney, Agent, or Firm*—Morgan & Finnegan LLP

(57) ABSTRACT

A variable displacement compressor includes a housing assembly having a control pressure chamber. A drive shaft is rotatably supported by the housing assembly. Cylinder bores, each accommodating a piston, are formed about the drive shaft. Each piston defines a compression chamber inside the corresponding cylinder bore. Each piston compresses refrigerant drawn into the corresponding compression chamber from a suction pressure zone and discharges the refrigerant to a discharge pressure zone. The inclination of a swash plate changes in accordance with the pressure in the control pressure chamber. A supply passage connects the control pressure chamber to the discharge pressure zone. A pressure release passage connects the control pressure chamber to the suction pressure zone. A shutter, which is made of synthetic resin or rubber and includes a restricting passage, closes one of the supply passage and the pressure release passage.

17 Claims, 7 Drawing Sheets

FLOW RESTRICTING STRUCTURE IN DISPLACEMENT CONTROLLING MECHANISM OF VARIABLE DISPLACEMENT COMPRESSOR

BACKGROUND OF THE INVENTION

The present invention relates to a flow restricting structure in a displacement controlling mechanism of a variable displacement compressor that varies the inclination angle of a swash plate by adjusting the pressure in a control chamber, which accommodates the swash plate.

In a variable displacement compressor described in Japanese Laid-Open Patent Publication No. 8-338364, increasing the pressure in a control chamber, which is a crank chamber in the above publication, decreases the inclination angle of a swash plate, thereby reducing the displacement of the compressor. Decreasing the pressure in the crank chamber increases the inclination angle of the swash plate, thereby increasing the displacement of the compressor. The pressure in the crank chamber is controlled by supplying refrigerant from a discharge chamber to the crank chamber and releasing refrigerant from the crank chamber to a suction chamber. A control valve is located in a passage through which refrigerant is supplied from the discharge chamber to the crank chamber. The control valve controls the flow rate of refrigerant supplied from the discharge chamber to the crank chamber.

Refrigerant in the crank chamber continuously flows out through a passage for releasing refrigerant from the crank chamber to the suction chamber. The flow rate of refrigerant from the crank chamber to the suction chamber needs to be controlled by arranging a restrictor in the passage.

However, since the cross-sectional area of a restrictor needs to be small, it is significantly difficult to directly bore the restrictor in the passage. Alternatively, a restrictor may be formed in a metallic member that is fitted to the passage. In this case, the metallic member needs to be fitted in the passage accurately and tightly in contact with the passage. The metallic member therefore needs to be manufactured with high accuracy. This is troublesome and increases the manufacturing cost.

SUMMARY OF THE INVENTION

Accordingly, it is an objective of the present invention to provide an inexpensive and easy-to-form flow restricting structure in a displacement controlling mechanism of a variable displacement compressor.

To achieve the above objective, the present invention provides a variable displacement compressor for compressing refrigerant that is drawn into a suction pressure zone and discharging the refrigerant to a discharge pressure zone. The compressor includes a housing assembly, a drive shaft,a plurality of cylinder bores, a plurality of pistons, a swash plate, a supply passage, a pressure release passage, and a shutter. The housing assembly has a control pressure chamber. The drive shaft is rotatably supported by the housing assembly. The cylinder bores are formed in the housing assembly and are arranged about the drive shaft. Each piston is accommodated in one of the cylinder bores and defines a compression chamber inside the cylinder bore. The swash plate is tiltably accommodated in the control pressure chamber and reciprocates each piston inside the corresponding cylinder bore. Each piston compresses refrigerant that is drawn into the corresponding compression chamber from the suction pressure zone and discharges the refrigerant to the discharge pressure zone. The inclination angle of the swash plate is varied in accordance with the pressure in the control pressure chamber. The supply passage connects the control pressure chamber to the discharge pressure zone. Refrigerant in the discharge pressure zone flows to the control pressure chamber through the supply passage. The pressure release passage connects the control pressure chamber to the suction pressure zone. Refrigerant in the control pressure chamber is released to the suction pressure zone through the pressure release passage. The shutter closes one of the supply passage and the pressure release passage. The shutter is made of synthetic resin or rubber and includes a restricting passage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is an enlarged partial cross-sectional view illustrating the compressor shown in FIG. 1(*a*);

FIG. 1(*c*) is a cross-sectional view taken along line 1*c*—1*c* in FIG. 1(*b*);

FIG. 7(*b*) is an enlarged partial cross-sectional view illustrating the compressor shown in FIG. 7(*a*);

FIG. 8(*b*) is a cross-sectional view taken along line 8*b*–8*b* in FIG. 8(*a*);

FIG. 10(*b*) is a cross-sectional view taken along line 10*b*–10*b* in FIG. 10(*a*).

DETAILED DESCRIPTION OF THE PREFERRED EMBODIMENTS

A first embodiment of the present invention will now be described with reference to FIGS. 1(*a*) to 3.

Figure 1:
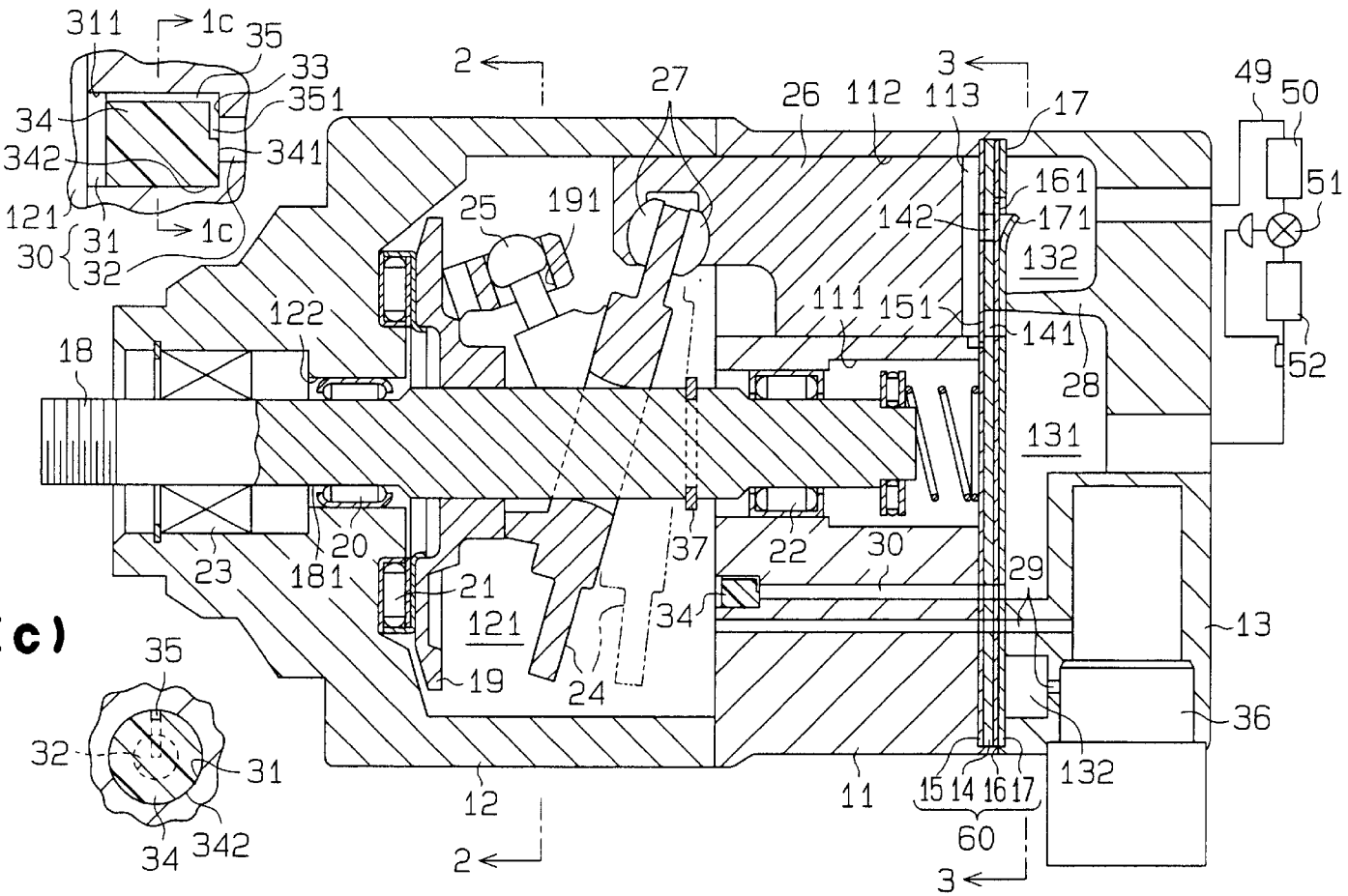
FIG. 1(*a*) is a cross-sectional view illustrating a compressor according to a first embodiment of the present invention.

As shown in FIG. 1(*a*), a front housing member 12 is secured to the front end of a cylinder block 11. A rear housing member 13 is secured to the rear end of the cylinder block 11 with a valve plate assembly 60 arranged in between. The valve plate assembly 60 includes a main plate 14, a first sub-plate 15, a second sub-plate 16, and a retainer plate 17. The left end of the compressor in FIG. 1(*a*) is defined as the front of the compressor, and the right end is defined as the rear of the compressor.

The front housing member 12 and the cylinder block 11 define a control pressure chamber 121. The control pressure chamber 121 rotatably supports a drive shaft 18. The drive shaft 18 extends through the control pressure chamber 121. A lug plate 19 is fixed to the drive shaft 18 inside the control pressure chamber 121. A first radial bearing 20 is arranged between the circumferential surface of a shaft hole 122 of the front housing member 12 and the drive shaft 18. A thrust bearing 21 is arranged between the front housing member 12 and the lug plate 19. A central bore 111 is formed at the center of the cylinder block 11. A second radial bearing 22 is arranged between the rear end of the drive shaft 18, which is inserted in the central bore 111, and the circumferential surface of the central bore 111. The drive shaft 18 is rotatably supported by the front housing member 12 via the first radial bearing 20. The drive shaft 18 is rotatably supported by the cylinder block 11 via the second radial bearing 22. In the first embodiment, the front housing member 12, the cylinder block 11, and the rear housing member 13 form the housing assembly.

The drive shaft 18 projects outside of the compressor through the shaft hole 122. The projecting portion of the drive shaft 18 is connected to and driven by the external drive source (such as a vehicular engine), which is not shown. A mechanical seal 23 is arranged between the shaft hole 122 and the drive shaft 18. The mechanical seal 23 prevents gas from leaking along the circumferential surface 181 of the drive shaft 18 from the control pressure chamber 121.

Figure 2:
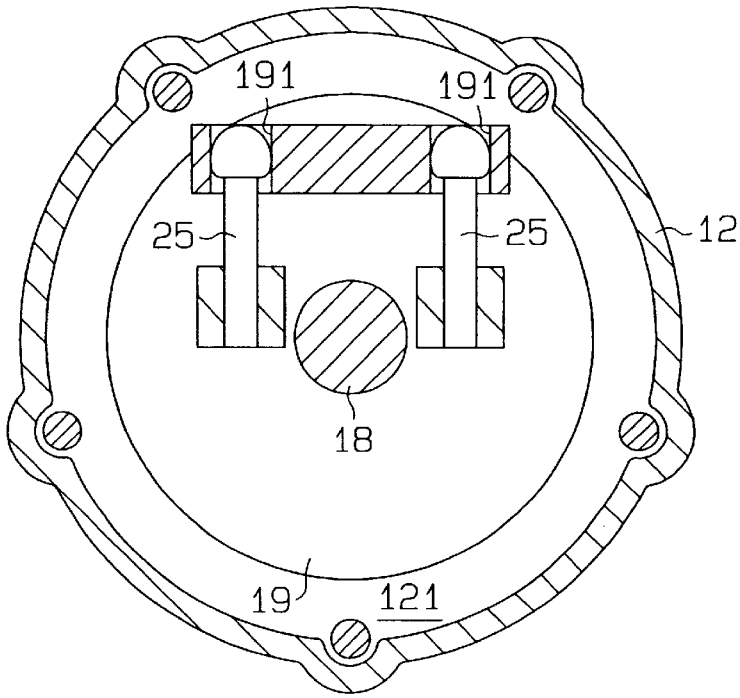
FIG. 2 is a cross-sectional view taken along line 2—2 in FIG. 1(*a*)

A swash plate 24 is supported by the drive shaft 18. The swash plate 24 slides along and tilts with respect to the axial direction of the drive shaft 18. In other words, the swash plate is tiltably accommodated at an inclination angle in the control pressure chamber 121. A pair of guide pins 25 (see FIG. 2) is secured to the swash plate 24. Each guide pin 25 is slidably inserted in one of guide holes 191 formed on the lug plate 19. The cooperation of the guide holes 191 and the guide pins 25 permits the swash plate 24 to tilt with respect to the axial direction of the drive shaft 18 and rotate integrally with the drive shaft 18.

Figure 3:
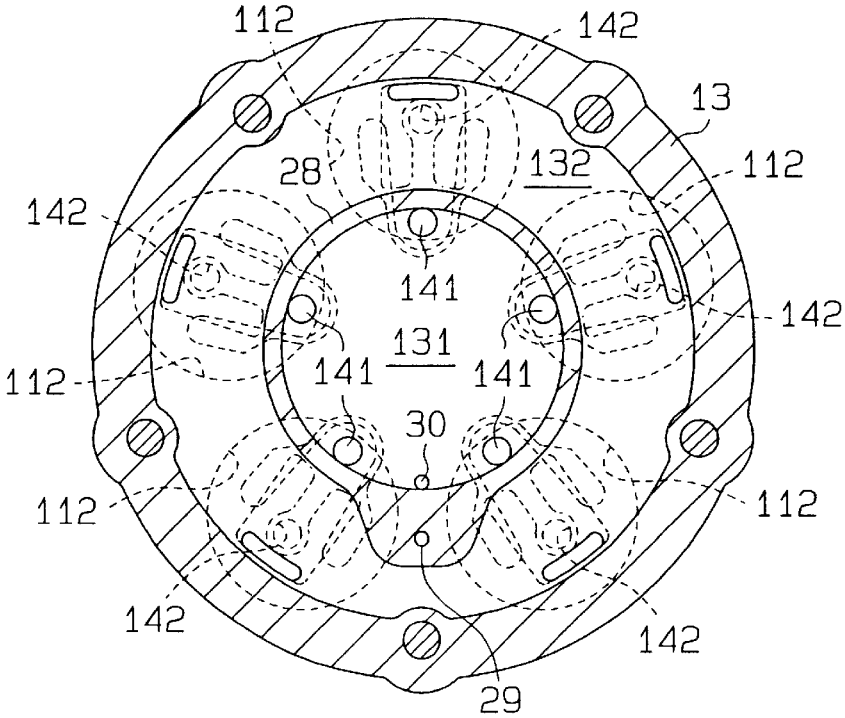
FIG. 3 is a cross sectional view taken along line 3—3 in FIG. 1(*a*)

Cylinder bores 112 are formed about the drive shaft 18 in the cylinder block 11 at equal angular intervals. (Only one cylinder bore is shown in FIG. 1(*a*) but five cylinder bores are formed in the first embodiment as shown in FIG. 3) Each cylinder bore 112 accommodates a piston 26. Each piston 26 defines a compression chamber 113 in the corresponding cylinder bore 112. The rotation of the swash plate 24, which rotates integrally with the drive shaft 18, is converted to the reciprocation of the pistons 26 via the shoes 27. Thus, each piston 26 reciprocates inside the corresponding cylinder bore 112.

As shown in FIG. 3, a suction chamber 131, which is a suction pressure zone, and a discharge chamber 132, which is a discharge pressure zone, are defined in the rear housing member 13. The discharge chamber 132 surrounds the suction chamber 131. The suction chamber 131 is separated from the discharge chamber 132 by a dividing wall 28.

The valve plate assembly 60 has suction ports 141, suction valve flaps 151, discharge ports 142, and discharge valve flaps 161. Each set of one suction port 141, one suction valve flap 151, one discharge port 142, and one discharge valve flap 161 corresponds to one of the cylinder bores 112. Each cylinder bore 112 is communicated with the suction chamber 131 via the corresponding suction port 141. Each cylinder bore 112 is communicated with the discharge chamber 132 via the corresponding discharge port 142.

As shown in FIG. 1(*a*), when each piston 26 moves from the top dead center to the bottom dead center (from the right side to the left side in FIG. 1(*a*)), refrigerant gas in the suction chamber 131 is drawn into the corresponding compression chamber 113 via the corresponding suction port 141 and suction valve flap 151. When each piston 26 moves from the bottom dead center to the top dead center (from the left side to the right side in FIG. 1(*a*)), refrigerant in the corresponding compression chamber 113 is compressed to a predetermined pressure and is discharged to the discharge chamber 132 via the corresponding discharge port 142 and discharge valve flap 161. The retainer plate 17 includes retainers 171, which correspond to the discharge valves 161. Each retainer restricts the opening degree of the corresponding discharge valve flap 161. When refrigerant is discharged from each compression chamber 113 to the discharge chamber 132, a compression reaction force is generated. The compression reaction force is received by the front housing member 12 via the corresponding piston 26, the shoes 27, the swash plate 24, the guide pins 25, the lug plate 19, and the thrust bearing 21. Refrigerant in the discharge chamber 132 then flows to the suction chamber 131 through an external refrigerant circuit 49, which includes a condenser 50, an expansion valve 51, and an evaporator 52.

The discharge chamber 132 is connected to the control pressure chamber 121 via a supply passage 29, which extends through the cylinder block 11. The supply passage 29 transfers refrigerant in the discharge chamber 132 to the control pressure chamber 121. The control pressure chamber 121 is connected to the suction chamber 131 via a pressure release passage 30, which extends through the cylinder block 11. As shown in FIG. 1(*b*), the pressure release passage 30 having a circular cross-section includes a large diameter section 31 and a small diameter section 32. The large diameter section 31 is defined by a passage defining wall 311. Refrigerant in the control pressure chamber 121 flows to the suction chamber 131 through the pressure release passage 30. That is, the pressure in the control pressure chamber 121 is released into the suction chamber 131 through the pressure release passage 30.

As shown in FIG. 1(*b*), a columnar shutter 34, which is made of synthetic resin, is fitted in the large diameter section 31. An end surface 341 of the shutter 34 contacts a step 33 formed between the large diameter section 31 and the small diameter section 32. A restricting groove 35 is formed on the surface of the shutter 34, to extend longitudinally along a circumferential surface 342 of the shutter 34 and radially along the end surface 341. The large diameter section 31 is communicated with the small diameter section 32 via the restricting groove 35. The pressure in the control pressure chamber 121 is adjusted by releasing pressure through the restricting groove 35 of the shutter 34.

As shown in FIG. 1(*a*), an electromagnetic control valve 36 is arranged in the supply passage 29. The control valve 36 is excited and de-excited by a controller (not shown). The controller excites and de-excites the control valve 36 in accordance with the passenger room temperature detected by a temperature sensor (not shown), and a target temperature, which is set by a temperature determining device (not shown). When no current is supplied to the control valve 36, the control valve 36 is in a released state. When current is supplied to the control valve 36, the control valve 36 is in a closed state. That is, when the control valve 36 is de-excited, refrigerant in the discharge chamber 132 flows to the control pressure chamber 121, and when the control valve 36 is excited, refrigerant in the discharge chamber 132 does not flow to the control pressure chamber 121. The control valve 36 controls the flow of refrigerant from the discharge chamber 132 to the control pressure chamber 121.

The inclination angle of the swash plate 24 is changed in accordance with the pressure in the control pressure chamber 121. Increasing the pressure in the control pressure chamber 121 reduces the inclination angle of the swash plate 24, and decreasing the pressure in the control pressure chamber 121 increases the inclination angle of the swash plate 24. When refrigerant is supplied from the discharge chamber 132 to the control pressure chamber 121, the pressure in the control pressure chamber 121 increases. When the supply of refrigerant from the discharge chamber 132 to the control pressure chamber 121 is stopped, the pressure in the control pressure chamber 121 decreases. That is, the inclination angle of the swash plate 24 is controlled by the control valve 36.

The maximum inclination of the swash plate 24 is determined by the contact between the lug plate 19 and the swash plate 24. A snap ring 37 arranged on the drive shaft 18 determines the minimum inclination of the swash plate 24.

The first embodiment provides the following advantages.

(1-1) The part of the circumferential surface 342 of the shutter 34 on which the restricting groove 35 is formed need not be tightly in contact with the passage defining wall 311 of the large diameter section 31. That is, the diameter of the shutter 34 may be slightly smaller than the diameter of the large diameter section 31.

The shutter 34 is made of synthetic resin, which permits the shutter 34 to be elastically deformed. Therefore, even if the diameter of the shutter 34 is slightly larger than the diameter of the large diameter section 31, the shutter 34 can be fitted to the large diameter section 31 by the elastic deformation.

That is, the shutter 34 need not be manufactured with high dimensional accuracy. Therefore, the shutter 34 is manufactured at low cost. Furthermore, the shutter 34 can easily be manufactured by molding.

(1-2) The restricting groove 35 can easily be formed by molding.

(1-3) The restricting groove 35 can easily be formed on the surface of the shutter 34. The surface of the shutter 34 is suitable for forming the restricting groove 35.

(1-4) For example, in the case where the diameter of the shutter 34 is smaller than the diameter of the large diameter section 31, the sum of the cross-sectional area of a space formed between the passage defining wall 311 of the large diameter section 31 and the circumferential surface 342 of the shutter 34 and the cross-sectional area of the restricting groove 35 exceeds the appropriate restricting area. However, the end surface 341 of the shutter 34 is tightly in contact with the step 33 by the pressure difference between the control pressure chamber 121 and the suction chamber 131. Furthermore, a space having a predetermined dimension an end surface 341 faces the step 33 with a space having a predetermined dimension between the end surface 341 and the step 33. The dimension of the space is arranged to be appropriate for restricting the flow rate of refrigerant between the control pressure chamber 121 and the suction chamber 131. Therefore, the cross-sectional area of a passage defined by the end surface 341 and the step 33 is equivalent to the appropriate cross-sectional area of the restricting groove 35. Thus, the restricting groove 35 reliably restricts the flow rate of refrigerant.

Figure 4:
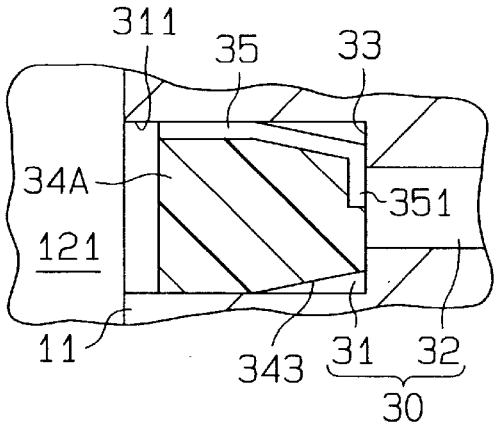
FIG. 4 is an enlarged partial cross-sectional view illustrating a compressor according to a second embodiment of the present invention.

The second embodiment will now be described with reference to FIG. 4. Like or the same reference numerals are given to those components that are like or the same as the corresponding components of the embodiment of FIGS. 1(*a*) to 3 and detailed explanations are omitted.

A tapered portion 343 is formed on a shutter 34A, which is formed of synthetic resin. The diameter of the distal portion of the tapered portion 343 is smaller than the diameter of the large diameter section 31. Therefore, the shutter 34A is easily fitted into the large diameter section 31.

Figure 5:
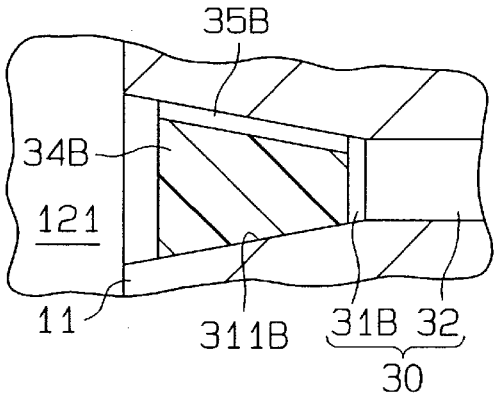
FIG. 5 is an enlarged partial cross-sectional view illustrating a compressor according to a third embodiment of the present invention.

The third embodiment will now be described with reference to FIG. 5. In the third embodiment, like or the same reference numerals are given to those components that are like or the same as the corresponding components of the second embodiment shown in FIG. 4.

A shutter 34B is a truncated cone made of synthetic resin. A restricting groove 35B is formed on the surface of the shutter 34B to extend along the conical surface of the shutter 34B. A passage defining wall 311B of a large diameter section 31B is a conical surface. The shutter 34B can easily be fitted into the large diameter section 31B.

Figure 6:
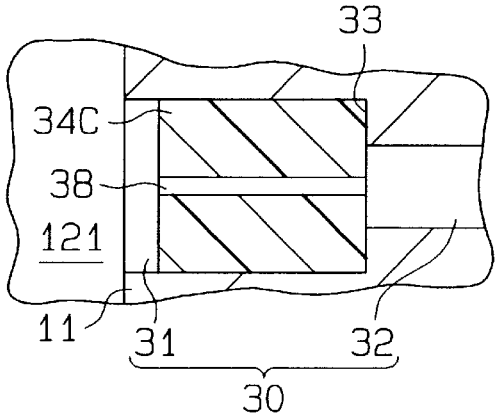
FIG. 6 is an enlarged partial cross-sectional view illustrating a compressor according to a fourth embodiment of the present invention.

The fourth embodiment will now be described with reference to FIG. 6. In the fourth embodiment, like or the same reference numerals are given to those components that are like or the same as the corresponding components of the first embodiment shown in FIGS. 1(*a*) to 3.

A restricting passage 38 extends through the axial center of a shutter 34C formed of synthetic resin. The shutter 34C can be formed by molding. Thus, the restricting passage 38 can easily be formed by molding or boring.

Figure 7B:
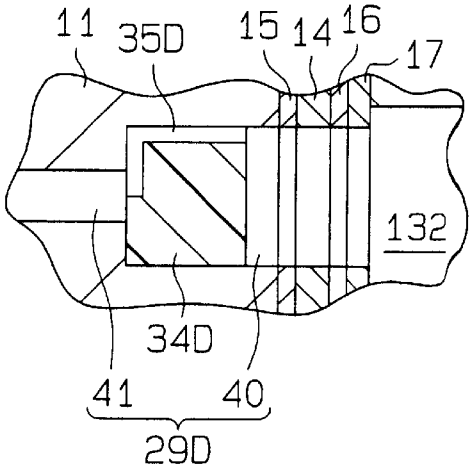
FIG. 7(*a*) is a partial cross-sectional view illustrating a compressor according to a fifth embodiment of the present invention.
Figure 7A:
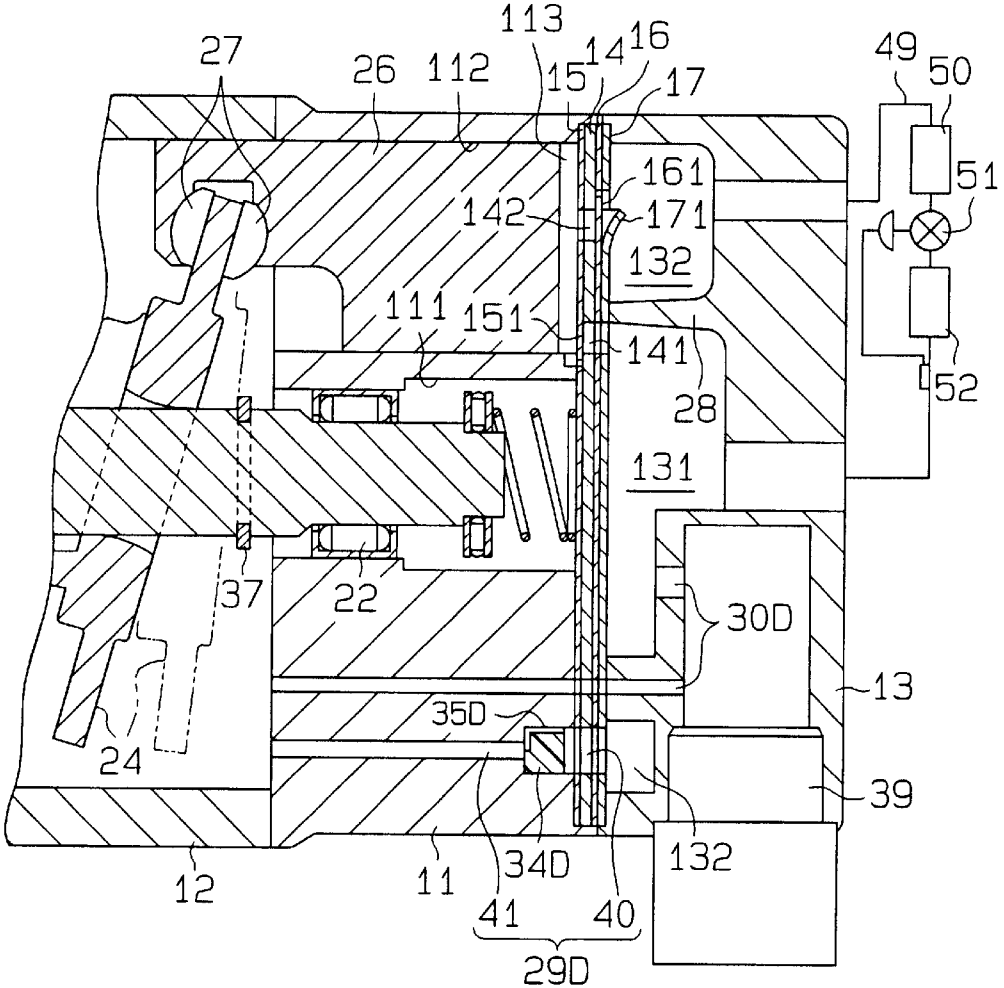

The fifth embodiment will now be described with reference to FIGS. 7(*a*) and 7(*b*). Like or the same reference numerals are given to those components that are like or the same as the corresponding components of the first embodiment of FIGS. 1(*a*) to 3 and detailed explanations are omitted.

An electromagnetic control valve 39 is located in a pressure release passage 30D. The control valve 39 is excited and de-excited by a controller (not shown). When the current supply to the control valve 39 is stopped, the control valve 39 is in a closed state. When current is supplied to the control valve 39, the control valve 39 is in an open state. That is, when the control valve 39 is de-excited, refrigerant in the control pressure chamber 121 does not flow to the suction chamber 131, and when the control valve 39 is excited, refrigerant in the control pressure chamber 121 flows to the suction chamber 131. The control valve 39 controls the flow of refrigerant from the control pressure chamber 121 to the suction chamber 131.

A supply passage 29D having a circular cross-section includes a large diameter section 40 and a small diameter section 41. Refrigerant in the discharge chamber 132 flows into the control pressure chamber 121 via the supply passage 29D. That is, the pressure in the discharge chamber 132 is released into the control pressure chamber 121 through the supply passage 29D. A shutter 34D, which is formed of synthetic resin, is fitted in the large diameter section 40. A restricting groove 35D is formed on the surface of the shutter 34D to extend along the circumferential surface of the shutter 34D.

The fifth embodiment provides the same advantages as the first embodiment shown in FIGS. 1(*a*) to 3.

The sixth embodiment will now be described with reference to FIGS. 8(*a*) and 8(*b*). Like or the same reference numerals are given to those components that are like or the same as the corresponding components of the first embodiment of FIGS. 1(*a*) to 3 and detailed explanations are omitted.

The central bore 111 is communicated with the suction chamber 131 via a port 143, which is formed in the valve plate assembly 60. A shutter 42 is arranged between the circumferential surface of the central bore 111 and the end portion of the drive shaft 18. The shutter 42 is made of synthetic resin such as polytetrafluoro-ethylene. A snap ring 53 is arranged on the circumferential surface of the central bore 111. The snap ring 53 restricts the movement of the shutter 42 from a position closer to the control pressure chamber 121 toward the suction chamber 131.

Figure 8B:
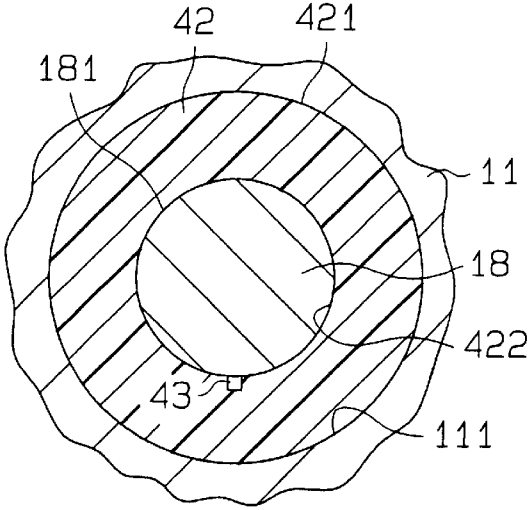
FIG. 8(*a*) is a partial cross-sectional view illustrating a compressor according to a sixth embodiment of the present invention.
Figure 8A:
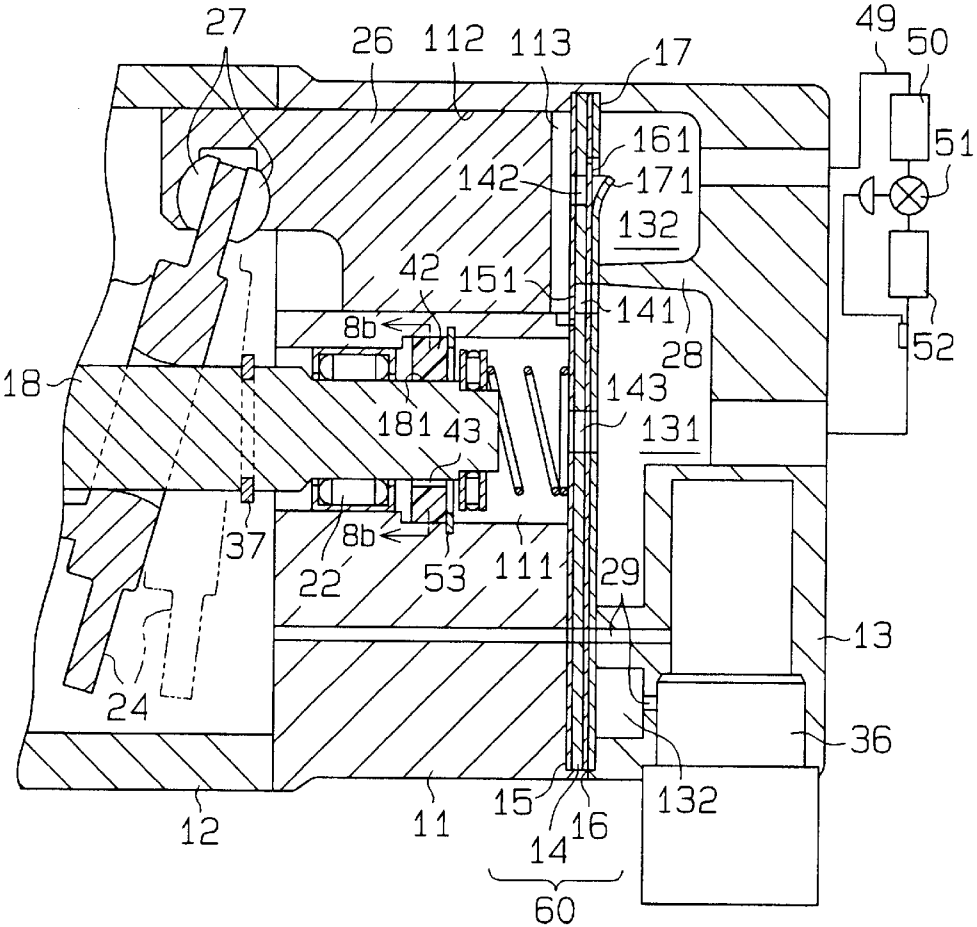

As shown in FIG. 8(*b*), an outer circumferential surface 421 of the shutter 42 is tightly in contact with the circumferential surface of the central bore 111. An inner circumferential surface 422 of the shutter 42 is slidably and tightly in contact with the circumferential surface 181 of the drive shaft 18. The shutter 42 slides along the circumferential surface 181 of the drive shaft 18 or the circumferential surface of the central bore 111 with the rotation of the drive shaft 18. Alternately, the shutter 42 slides along both the circumferential surface 181 of the drive shaft 18 and the circumferential surface of the central bore 111 with the rotation of the drive shaft 18.

A restricting groove 43 is formed along the axial direction of the drive shaft 18 on the inner circumferential surface 422 of the shutter 42. The control pressure chamber 121 is communicated with the suction chamber 131 via the restricting groove 43 and the port 143. Refrigerant in the control pressure chamber 121 flows to the suction chamber 131 through spaces in the second radial bearing 22, the restricting groove 43, and the port 143.

The sixth embodiment provides the following advantages.

(6-1) The shutter 42 permits refrigerant to move from the control pressure chamber 121 to the suction chamber 131. However, it is not required that the shutter 42 perfectly prevent leakage of refrigerant between the inner circumferential surface 422 of the shutter 42 and the circumferential surface 181 of the drive shaft 18 and between the outer circumferential surface 421 of the shutter 42 and the circumferential surface of the central bore 111. Therefore, the shutter 42 can be manufactured without high accuracy as long as the shutter 42 can be fitted to the drive shaft 18 and the central bore 111 to slide along the circumferential surface 181 of the drive shaft 18 or the circumferential surface of the central bore 111. That is, the shutter 42 need not be manufactured with high dimensional accuracy. Therefore, the shutter 42 is easily manufactured at low cost.

(6-2) The restricting groove 43 is easily formed on the inner circumferential surface 422 of the shutter 42. The inner circumferential surface 422 of the shutter 42 is suitable for forming the restricting groove 43.

(6-3) The synthetic resin, which has lower frictional force than metal, is suitable for the shutter 42. Particularly, polytetrafluoro-ethylene, which has low frictional force, is optimal for the shutter 42.

(6-4) Refrigerant in the control pressure chamber 121 flows to the suction chamber 131 through the second radial bearing 22 and the restricting groove 43. Therefore, lubricating oil flows with refrigerant that moves from the control pressure chamber 121 to the central bore 111. This reliably lubricates the second radial bearing 22.

Figure 9:
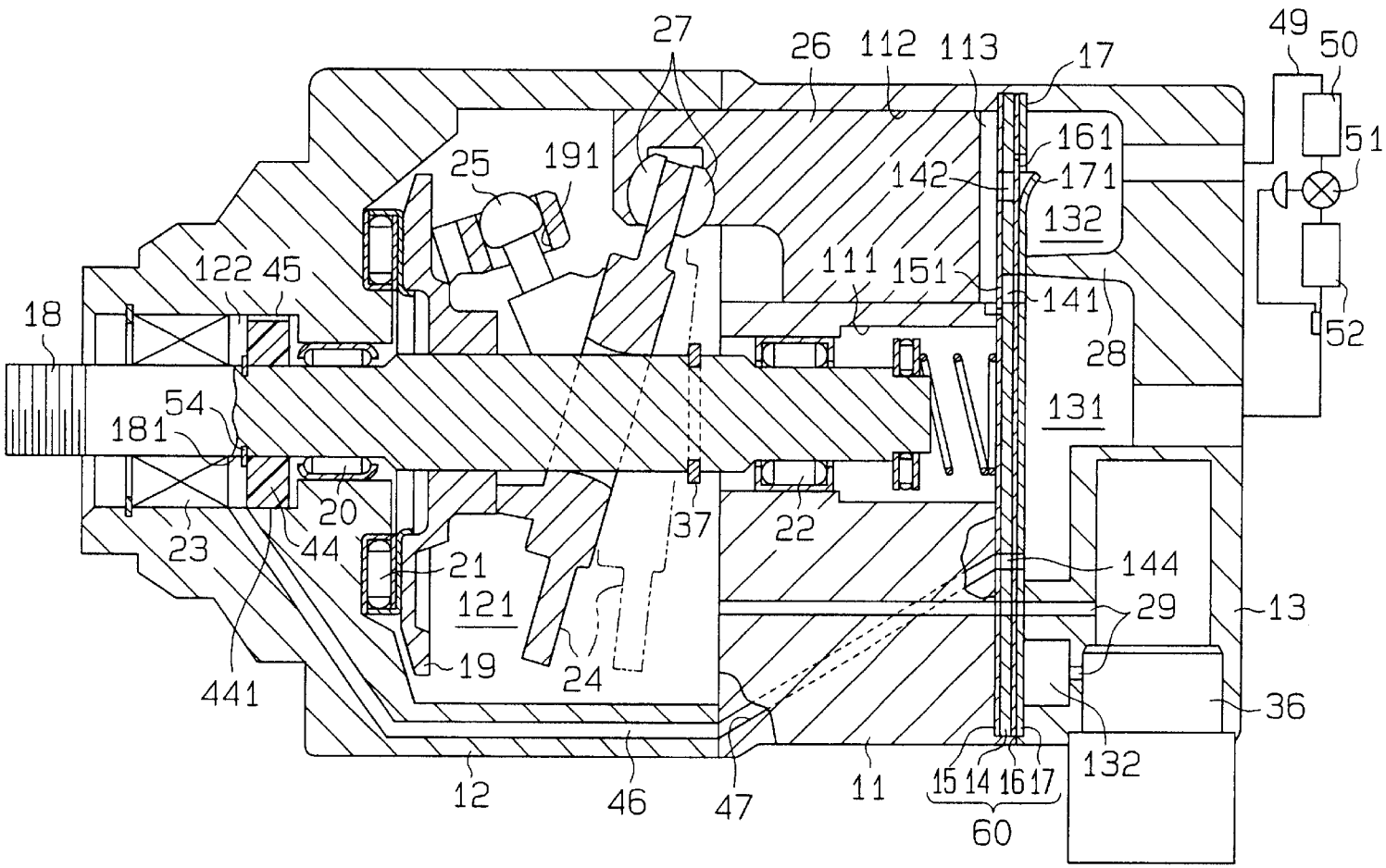
FIG. 9 is a cross sectional view illustrating a compressor according to a seventh embodiment of the present invention.

The seventh embodiment will now be described with reference to FIG. 9. Like or the same reference numerals are given to those components that are like or the same as the corresponding components of the first embodiment of FIGS. 1(*a*) to 3 and detailed explanations are omitted.

A shutter 44 made of synthetic resin is fitted between the drive shaft 18 and the circumferential surface of the shaft hole 122. A snap ring 54 is located on the circumferential surface 181 of the drive shaft 18. The snap ring 54 restricts the movement of the shutter 44 from a position closer to the first radial bearing 20 toward the mechanical seal 23. A restricting passage, which is a restricting groove 45 in the seventh embodiment, is formed on the surface of the shutter 44 to extend along the axial direction of the drive shaft 18 on the outer circumferential surface 441 of the shutter 44. Part of the shaft hole 122, which is positioned by the mechanical seal 23 and the shutter 44, is communicated with the control pressure chamber 121 via the restricting groove 45.

The shaft hole 122 is communicated with the suction chamber 131 via a first passage 46, which is formed in the front housing member 12, a second passage 47, which is formed in the cylinder block 11, and a port 144 formed in the valve plate assembly 60. Refrigerant in the control pressure chamber 121 flows to the suction chamber 131 through the thrust bearing 21, the first radial bearing 20, the restricting groove 45, the shaft hole 122, the first and second passages 46, 47, and the port 144.

The seventh embodiment provides the same advantages as (6-1), (6-2), and (6-3) of the sixth embodiment shown in FIGS. 8(*a*) and 8(*b*).

The restricting groove 45 is easily formed on the outer circumferential surface 441 of the shutter 44. The outer circumferential surface 441 of the shutter 44 is suitable for forming the restricting groove 45.

Refrigerant in the control pressure chamber 121 flows to the suction chamber 131 through the thrust bearing 21 and the first radial bearing 20. Therefore, lubricating oil flows with refrigerant that moves from the control pressure chamber 121 to the shaft hole 122. This reliably lubricates the thrust bearing 21 and the first radial bearing 20.

The eighth embodiment will now be described with reference to FIGS. 10(*a*) and 10(*b*). Like or the same reference numerals are given to those components that are like or the same as the corresponding components of the seventh embodiment of FIG. 9 and detailed explanations are omitted.

A ring 48, which is fitted between the drive shaft 18 and the shaft hole 122, is made of rubber (such as nitrile-butadiene rubber (NBR)) and has a U-shaped cross-section. A restricting bore 481 extends through the substantial center of the ring 48. Part of the shaft hole 122, which is positioned by the mechanical seal 23 and the ring 48, is communicated with the control pressure chamber 121 through spaces in the thrust bearing 21 and the radial bearing 20, and through the restricting bore 481. Therefore, the pressure in the control pressure chamber 121 applied on the rear side of the shutter 48 brings the ring 48 tightly in contact with the circumferential surface 181 of the drive shaft 18 and the circumferential surface of the shaft hole 122. In the eighth embodiment, the restricting bore 481 and the ring 48 constitute a restricting mechanism.

The eighth embodiment provides the same advantages as (1-1), and (1-5) to (1-9) of the first embodiment shown in FIGS. 1(*a*) to 3.

NBR is suitable for the ring 48 in that NBR has anti-deterioration property against the refrigerant and the lubricating oil.

The elastic deformation of rubber permits the ring 48 to be manufactured with less dimensional accuracy compared to a case when the ring 48 is formed of synthetic resin. Therefore, the ring 48 made of rubber is manufactured more easily than the ring 48 made of synthetic resin.

It should be apparent to those skilled in the art that the present invention may be embodied in many other specific forms without departing from the spirit or scope of the invention. Particularly, it should be understood that the invention may be embodied in the following forms.

(1) The shutter 34, 34A, 34B, 34C and 34D in the embodiments shown in FIGS. 1(*a*) to 7(*b*) may be made of rubber (such as NBR).

(2) The shutter 42, 44 in the embodiments shown in FIGS. 8(*a*) to 9 may be made of rubber (such as NBR).

Figure 10B:
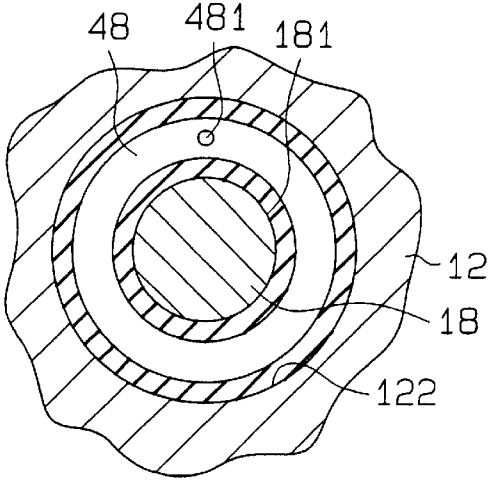
FIG. 10(*a*) is a partial cross-sectional view illustrating a compressor according to an eighth embodiment of the present invention.
Figure 10A:
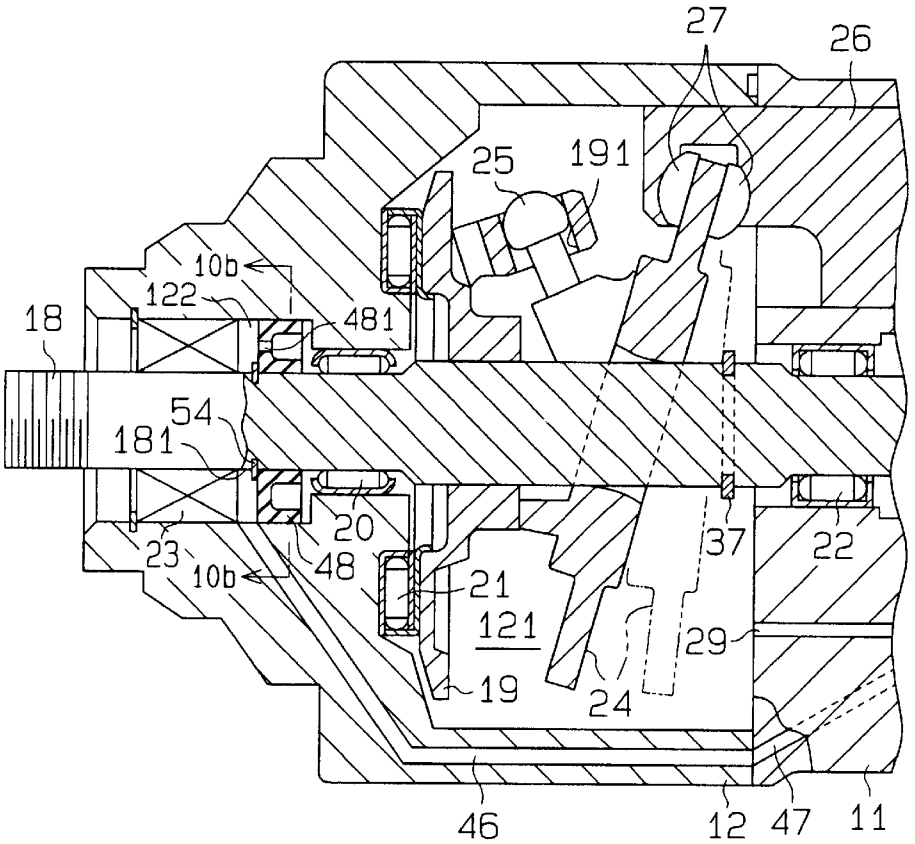

(3) The ring 48 in the eighth embodiment shown in FIGS. 10(*a*) and 10(*b*) may be made of synthetic resin.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor for compressing refrigerant that is drawn into a suction pressure zone and discharging the refrigerant to a discharge pressure zone, the compressor comprising:

a housing assembly, which has a control pressure chamber;

a drive shaft, which is rotatably supported by the housing assembly;

a plurality of cylinder bores formed in the housing assembly, wherein the cylinder bores are arranged about the drive shaft;

a plurality of pistons, each of which is accommodated in one of the cylinder bores, wherein each piston defines a compression chamber inside the corresponding cylinder bore;

a swash plate, which is tiltably accommodated in the control pressure chamber, wherein the swash plate reciprocates each piston inside the corresponding cylinder bore, and each piston compresses refrigerant that is drawn into the corresponding compression chamber from the suction pressure zone and discharges the refrigerant to the discharge pressure zone, and wherein the inclination angle of the swash plate is varied in accordance with the pressure in the control pressure chamber;

a supply passage, which connects the control pressure chamber to the discharge pressure zone, wherein refrigerant in the discharge pressure zone flows to the control pressure chamber through the supply passage;

a pressure release passage, which connects the control pressure chamber to the suction pressure zone, wherein refrigerant in the control pressure chamber is released to the suction pressure zone through the pressure release passage; and a shutter for closing one of the supply passage and the pressure release passage, wherein the shutter is made of synthetic resin or rubber and includes a restricting passage.

2. The compressor according to claim 1, wherein the restricting passage is a groove formed on the shutter.

3. The compressor according to claim 1, wherein a passage closed by the shutter is defined by a passage defining wall formed on the housing assembly and has a circular cross-section, and wherein the shutter is fitted to the passage defining wall.

4. The compressor according to claim 1, wherein a passage closed by the shutter has an annular cross section, wherein the passage is defined by the circumferential surface of the drive shaft and a passage defining wall formed on the housing assembly, which surrounds the drive shaft, and the shutter has an annular cross-section and surrounds the drive shaft, and wherein the shutter is fitted between the circumferential surface of the drive shaft and the passage defining wall.

5. The compressor according to claim 4, wherein the shutter is made of polytetrafluoro-ethylene.

6. The compressor according to claim 1, wherein the shutter is made of nitrile-butadiene rubber.

7. The compressor according to claim 1, wherein the restricting passage extends through the shutter.

8. The compressor according to claim 1, wherein a passage closed by the shutter has a large diameter section and a small diameter section, wherein a step is formed between the large diameter section and the small diameter section, wherein the shutter contacts the step.

9. A variable displacement compressor for compressing refrigerant that is drawn into a suction pressure zone and discharging the refrigerant to a discharge pressure zone, the compressor comprising:

a housing assembly, which has a control pressure chamber;

a drive shaft, which is rotatably supported by the housing assembly;

a plurality of cylinder bores formed in the housing assembly, wherein the cylinder bores are arranged about the drive shaft;

a plurality of pistons, each of which is accommodated in one of the cylinder bores, wherein each piston defines a compression chamber inside the corresponding cylinder bore;

a swash plate, which is tiltably accommodated in the control pressure chamber, wherein the swash plate reciprocates each piston inside the corresponding cylinder bore, and each piston compresses refrigerant that is drawn into the corresponding compression chamber from the suction pressure zone and discharges the refrigerant to the discharge pressure zone, and wherein the inclination angle of the swash plate is varied in accordance with the pressure in the control pressure chamber;

a supply passage, which connects the control pressure chamber to the discharge pressure zone, wherein refrigerant in the discharge pressure zone flows to the control pressure chamber through the supply passage, wherein the housing assembly has a passage defining wall, which defines the supply passage;

a pressure release passage, which connects the control pressure chamber to the suction pressure zone, wherein refrigerant in the control pressure chamber is released to the suction pressure zone through the pressure release passage, wherein the housing assembly has a passage defining wall, which defines the pressure release passage; and a shutter for closing one of the supply passage and the pressure release passage, wherein the shutter is fitted to the passage defining wall defining the corresponding passage, wherein the shutter is made of synthetic resin or rubber and includes a restricting passage.

10. The compressor according to claim 9, wherein the restricting passage is a groove formed on the shutter.

11. The compressor according to claim 9, wherein the passage closed by the shutter has a section having an annular cross-section.

12. The compressor according to claim 9, wherein the shutter is made of nitrile-butadiene rubber.

13. The compressor according to claim 9, wherein the restricting passage extends through the shutter.

14. A variable displacement compressor for compressing refrigerant that is drawn into a suction pressure zone and discharging the refrigerant to a discharge pressure zone, the compressor comprising:

a housing assembly, which has a control pressure chamber;

a drive shaft, which is rotatably supported by the housing assembly;

a plurality of cylinder bores formed in the housing assembly, wherein the cylinder bores are arranged about the drive shaft;

a plurality of pistons, each of which is accommodated in one of the cylinder bores, wherein each piston defines a compression chamber inside the corresponding cylinder bore;

a swash plate, which is tiltably accommodated in the control pressure chamber, wherein the swash plate reciprocates each piston inside the corresponding cylinder bore, and each piston compresses refrigerant that is drawn into the corresponding compression chamber from the suction pressure zone and discharges the refrigerant to the discharge pressure zone, and wherein the inclination angle of the swash plate is varied in accordance with the pressure in the control pressure chamber;

a supply passage, which connects the control pressure chamber to the discharge pressure zone, wherein refrigerant in the discharge pressure zone flows to the control pressure chamber through the supply passage;

a pressure release passage, which connects the control pressure chamber to the suction pressure zone, wherein refrigerant in the control pressure chamber is released to the suction pressure zone through the pressure release passage, wherein at least one of the supply passage and the pressure release passage has an annular section that is defined by the circumferential surface of the drive shaft and the circumferential wall of the housing assembly that surrounds the drive shaft; and an annular shutter for closing the annular section, wherein the shutter is fitted between the circumferential surface of the drive shaft and the housing assembly, wherein the shutter is made of synthetic resin or rubber and includes a restricting passage.

15. The compressor according to claim 14, wherein the restricting passage is a groove formed on the shutter.

16. The compressor according to claim 14, wherein the shutter is made of polytetrafluoro-ethylene.

17. The compressor according to claim 14, wherein the restricting passage extends through the shutter.

* * * * *